US011292036B2

(12) United States Patent
Borghi et al.

(10) Patent No.: US 11,292,036 B2
(45) Date of Patent: Apr. 5, 2022

(54) HANDLING SYSTEM OF A WASHING/RINSING HEAD FOR ONE TANK WASHING/RINSING PLANT FOR THE PHARMACEUTICAL SECTOR, PROCEDURE FOR USING THE SYSTEM

(71) Applicant: IWT S.R.L., Casale Litta (IT)

(72) Inventors: Matteo Borghi, Milan (IT); Maurizio Cosolo, Magenta (IT)

(73) Assignee: IWT S.R.L., Casale Litta (IT)

( * ) Notice: Subject to any disclaimer, the term of this patent is extended or adjusted under 35 U.S.C. 154(b) by 185 days.

(21) Appl. No.: 16/815,828

(22) Filed: Mar. 11, 2020

(65) Prior Publication Data

US 2020/0316659 A1 Oct. 8, 2020

(30) Foreign Application Priority Data

Mar. 13, 2019 (IT) ..... 102019000003645

(51) Int. Cl.
*B08B 9/093* (2006.01)

(52) U.S. Cl.
CPC ..... *B08B 9/093* (2013.01); *B08B 2209/08* (2013.01)

(58) Field of Classification Search
CPC ..... B08B 3/02; B08B 2203/02; B08B 9/093; B08B 9/0813; B08B 9/34; B08B 2209/08
See application file for complete search history.

(56) References Cited

U.S. PATENT DOCUMENTS 4,828,651 A 5/1989 Lumbroso et al.
5,106,428 A 4/1992 Goerss et al.
5,526,989 A 6/1996 Staples et al.

FOREIGN PATENT DOCUMENTS

CN 203389886 U 1/2014
CN 104226656 A 12/2014
(Continued)

OTHER PUBLICATIONS

Italian Search Report dated Nov. 19, 2019, issued in Italian Application No. 102019000003645, filed Mar. 13, 2019.

*Primary Examiner* — Natasha N Campbell
(74) *Attorney, Agent, or Firm* — Workman Nydegger

(57) ABSTRACT

System for moving a washing/rinsing head in a bin washing/rinsing apparatus for the pharmaceutical industry, the apparatus being equipped with a washing/rinsing chamber adapted to house one of the bins and the washing/rinsing head, the bin being provided with an opening adapted to allow the head to be introduced therein, the system being positioned over the washing/rinsing chamber and comprising: —a flexible tube, to one end of which the washing/rinsing head is connected, the flexible tube being adapted to carry washing/rinsing liquid, fed through a fixed second end of the tube, towards the washing/rinsing head; —a first idle wheel, positioned vertically above the washing/rinsing head, and adapted to cause a first deviation of the flexible tube towards a second idle wheel; —the second idle wheel, positioned laterally relative to the first idle wheel, adapted to cause a second deviation of the flexible tube in a direction substantially opposite to the first deviation; —a horizontal electric axis adapted to slidably house the pin of the second idle wheel; —the first and second idle wheels being adapted to deviate the flexible tube so that it runs along essentially horizontal sections towards the fixed second end; —an electronic controller adapted to cause the pin of the second idle wheel to slide within the horizontal axis, so as to control the vertical position of the washing/rinsing head in the washing/rinsing chamber through the sliding of the flexible tube on the first and second idle wheels.

10 Claims, 10 Drawing Sheets

(56) References Cited

FOREIGN PATENT DOCUMENTS

| | | | |
|---|---|---|---|
| DE | 199 58 290 | A1 | 6/2000 |
| EP | 0 918 577 | A1 | 6/1999 |
| EP | 1 533 046 | A1 | 5/2005 |
| EP | 2 497 578 | A2 | 9/2012 |

HANDLING SYSTEM OF A WASHING/RINSING HEAD FOR ONE TANK WASHING/RINSING PLANT FOR THE PHARMACEUTICAL SECTOR, PROCEDURE FOR USING THE SYSTEM

FIELD OF THE INVENTION

The present invention relates to a system for moving a washing/rinsing head in a bin washing/rinsing apparatus for the pharmaceutical industry, and to a method of using the system. In particular, the system is adapted for bin washing/rinsing applications in pharmaceutical production and/or preclinical research centres.

Background Art

It is known that in the field of pharmaceutical production it is necessary to employ washing systems for removing any residual pharmaceutical product or contaminant agents from the bins used for transforming and storing the drug. Such procedures must be used during normal single-product production and especially when the same apparatuses/components are used in multi-product lines. In this latter case, the washing procedure must ensure the elimination of any residues of pharmaceutical product and any contaminants thereof, as well as the elimination of the washing agents (rinsing) prior to starting the production of the next lot or product.

The bin (see FIG. 1 for an example of such bin) is a hollow container 1 typically having an inlet opening 4 at the top and a drain opening 3 at the bottom 2, which may be fitted with a bottom outlet valve 5.

Bins may have different shapes: they usually comprise a parallelepiped or cylindrical upper part 7 with the inlet opening 4, and a bottom 2 having a conical or pyramidal shape to facilitate product drainage.

The inside of the bin may be completely smooth or may include several systems useful for drug processing, such as stirrers, mixers, baffles, inspection and check points. The washing procedures employed for this type of pharmaceutical product are essentially three:

1) Manual: the operator, by following an appropriate procedure using water jets and detergent, manually removes the dirt from inside and outside the bin; the operator then rinses the bin by using the same technology. Washing occurs directly where the bin has been used (CIP—Cleaning In Place), or the bin is brought to a suitable washing area (COP—Cleaning Out of Place).
2) Automatic CIP: an automatically controlled pumping assembly is available directly in the bin working area. The delivery side of this assembly is connected to a suitable washing head, which, with the aid of various lifting systems, is lowered inside the bin to be washed. The washing solution is thus pumped into the bin, and the water then drops into suitable collection grates positioned under the bin.
3) Automatic COP: in this case, the bin is moved and brought into a suitable washing area where there is a completely automatic bin washing chamber. Once it has been loaded into the chamber, the bin undergoes a complete and verifiable internal and external washing/rinsing process, usually followed by a full drying step.

In automatic COP washing chambers, a complication is introduced by the fact that a washing head is needed which, when lowered from above, must be able to enter the bin to be washed. It must be taken into account that said bins may be very tall, resulting in the washing chambers exceeding 2 metres in height. Moreover, the process often requires a head that can be positioned at different levels, so as to be able to adequately reach all the internal regions of the bin.

This means that a system must be installed on top of the washing chamber which can fully raise the washing head to allow loading the bin at the beginning of the cycle and removing the bin at the end of the cycle, and which can bring the washing head down to very low heights during the cycle, resulting in a working travel exceeding 2 metres.

The whole system must then be compatible with industry-specific requirements, i.e. it must be self-draining and include no mechanical systems with interspaces or needing external lubrication, which might contaminate the product. Furthermore, the washing system should avoid contacting and rubbing against the surfaces of the bin.

In addition, it is necessary to consider that the regulations in force in the pharmaceutical industry must be complied with; therefore, telescopic systems or systems requiring room above the machine equalling the required travel within the chamber are normally employed.

It is apparent that this leads to significant installation heights (exceeding 4 metres), which are often incompatible with the installation locations.

SUMMARY OF THE INVENTION

It is therefore an object of the present invention to propose a system for moving a washing/rinsing head in a bin washing/rinsing apparatus for the pharmaceutical industry, and a method of using the system, which are aimed at overcoming all of the above-mentioned drawbacks.

In particular, the system is adapted for bin washing/rinsing applications in pharmaceutical production and/or preclinical research centres.

The present invention concerns a system for moving the washing head in a bin washing apparatus for the pharmaceutical industry, which requires little installation space while at the same time being compatible with the industry requirements. For moving the washing head, this system exploits a pulley train integrated into the washing system.

The present invention also concerns a system for moving a washing/rinsing head in a bin washing/rinsing apparatus for the pharmaceutical industry, said apparatus being equipped with a washing/rinsing chamber adapted to house one of said bins and said washing/rinsing head, said bin being provided with an opening adapted to allow said head to be introduced therein, the system being positioned over said washing/rinsing chamber and comprising:

- a flexible tube, to one end of which said washing/rinsing head is connected, said flexible tube being adapted to carry washing/rinsing liquid, fed through a fixed second end of the tube, towards said washing/rinsing head;
- a first idle wheel, positioned vertically above said washing/rinsing head, and adapted to cause a first deviation of said flexible tube towards a second idle wheel;
- said second idle wheel, positioned laterally relative to said first idle wheel, adapted to cause a second deviation of said flexible tube in a direction substantially opposite to said first deviation;
- a horizontal electric axis adapted to slidably house the pin of said second idle wheel;
- said first and second idle wheels being adapted to deviate said flexible tube so that it runs along essentially horizontal sections towards said fixed second end;
- an electronic controller adapted to cause the pin of said second idle wheel to slide within said horizontal axis, so as to control the vertical position of said washing/rinsing head in the washing/rinsing chamber through the sliding of said flexible tube on said first and second idle wheels.

The present invention further concerns a method of using the system for moving a washing/rinsing head as described above, comprising controlling said electronic controller in such a way as to cause said pin of the second idle wheel to slide within said horizontal electric axis, the flexible tube to slide around said first and second idle wheels, and said washing/rinsing head to be vertically positioned in said washing/rinsing chamber.

It is a particular object of the present invention to provide a system for moving a washing/rinsing head in a bin washing apparatus for the pharmaceutical industry, and a method of using the system, as will be further set out in the claims, which are an integral part of the present description.

BRIEF DESCRIPTION OF THE DRAWINGS

Further objects and advantages of the present invention will become apparent from the following detailed description of a preferred embodiment (and variants) thereof and from the annexed drawings, which are supplied merely by way of non-limiting example, wherein.

In the drawings, the same reference numerals and letters identify the same items or components.

DETAILED DESCRIPTION OF SOME EMBODIMENTS OF THE INVENTION

Figure 1:
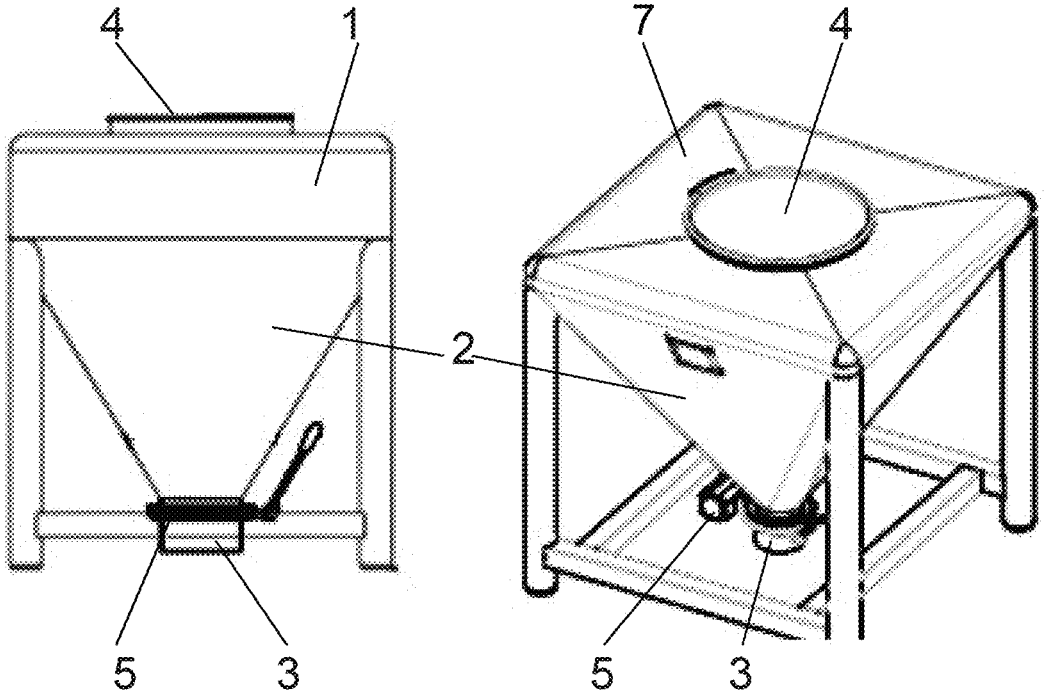
FIG. 1 PRIOR ART
FIG. 1 shows an example of a known type of bin, which is to be washed by the system of the invention, in lateral and perspective views.

The following will describe, with reference to the annexed drawings, one exemplary embodiment of the system for moving the washing/rinsing head (hereafter referred to, for brevity's sake, as washing head) in a bin washing/rinsing apparatus for the pharmaceutical industry. The apparatus comprises a washing/rinsing chamber 11 (hereafter referred to, for brevity's sake, as washing chamber) and the moving system positioned over the chamber.

A washing head 10 is introduced into the washing chamber 11 of the washing/rinsing apparatus, the latter being of a per se known type and hence only schematized in the drawings. The washing head is also of a per se known type. In particular, it is preferably of the type comprising nozzles capable of spraying washing/rinsing liquid in all directions.

The washing head 10 is connected to an adequately thick flexible tube 12, which is made of a material having characteristics compatible with the industry requirements, and which comprises an inner core and an outer sheath.

Figure 8:
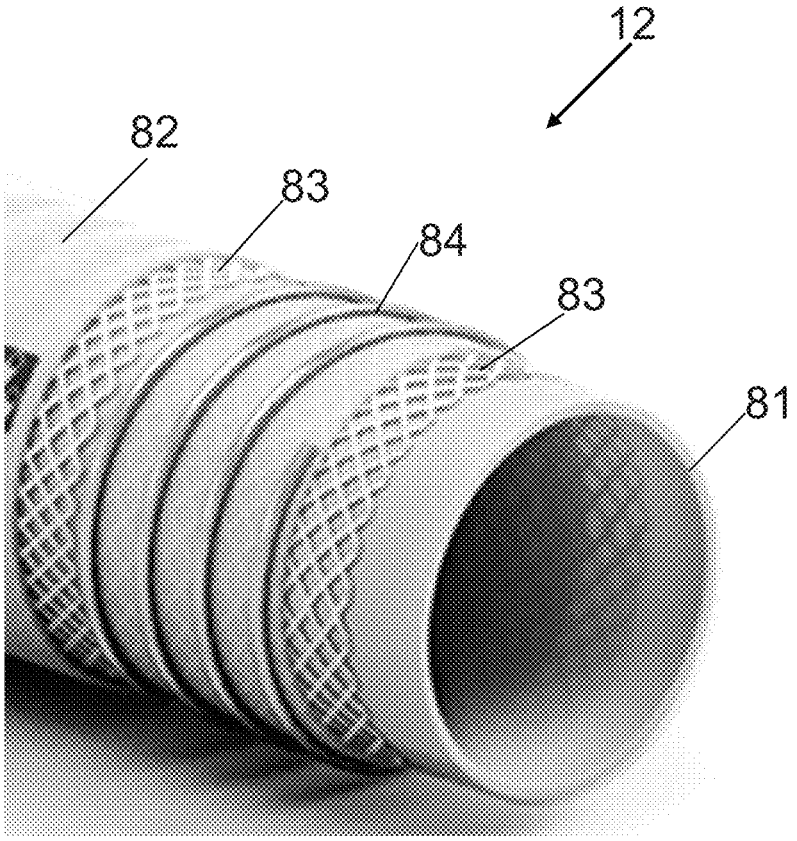
FIG. 8 shows a magnification of a section of a flexible tube included in the moving system.

An exemplifying embodiment of the flexible tube 12 is shown in FIG. 8. It comprises an inner layer 81 made of FDA-compliant translucent silicone, an outer layer 82 made of heat-resistant smooth silicone, and an intermediate layer. The latter comprises reinforcement layers 83 made of temperature-resistant and pressure-resistant textile, with a reinforcing stainless-steel spiral 84 in between.

The flexible tube 12 runs through a clamp-type connection 13, shaped in a per se known manner, positioned on top of the chamber 11, and through a sleeve valve 14, positioned over the chamber connection 13, adapted to either allow or not allow the tube to slide.

The clamp-type connection 13 connects the moving system mechanically to the upper part of the chamber 11.

Figure 9:
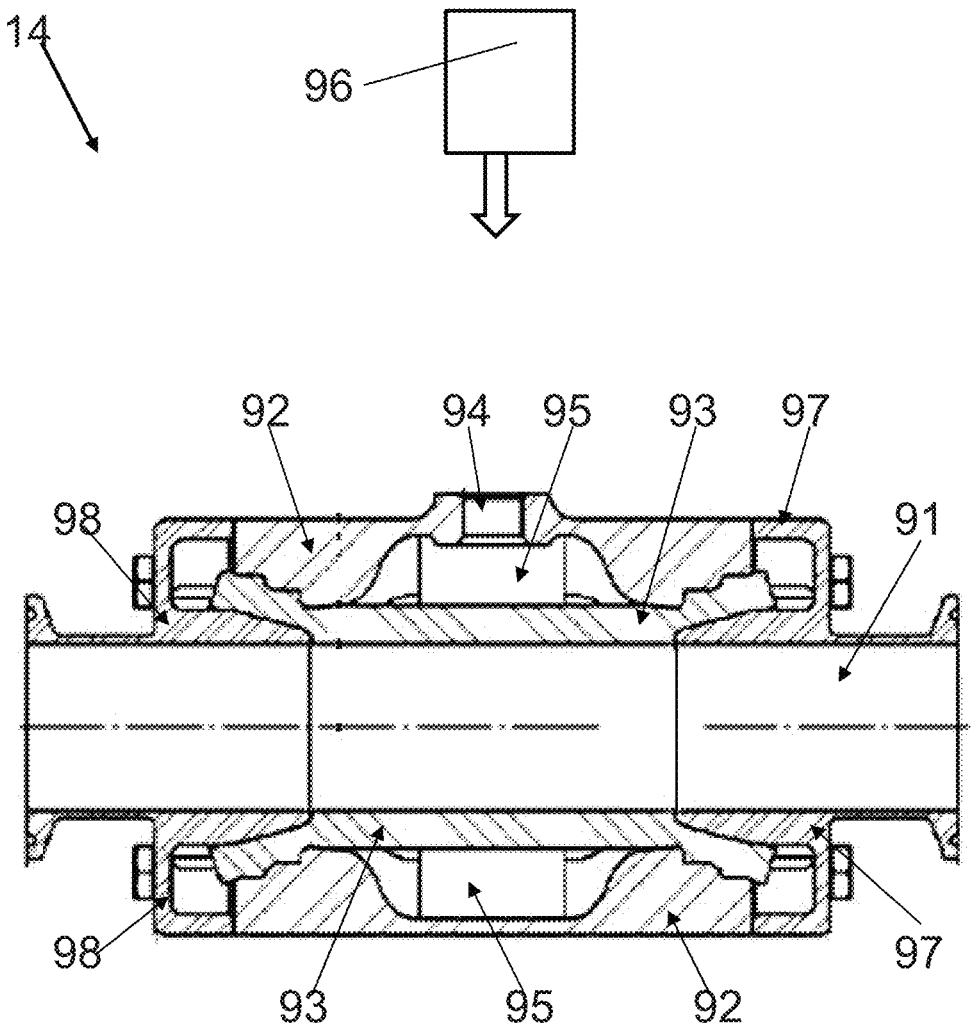
FIG. 9 shows a magnified sectional view of the sleeve valve included in the moving system.

An exemplifying embodiment of the sleeve valve 14 is shown in a sectional view in FIG. 9. It comprises:

- a central cavity 91, in which the flexible tube 12 slides;
- a body 92 made of stainless steel;
- a central sleeve 93 made of FDA-compliant EPDM rubber, adapted to act as a vice for compressing or releasing the flexible tube;
- two flange-shaped terminal parts 97, 98 made of stainless steel;
- an inflation chamber 95 between the stainless-steel body 92 and the central rubber sleeve 93;
- an inlet 94 for compressed air, which, by filling the inflation chamber 95 with air, compresses or releases the central sleeve 93; compressed air is supplied through a pneumatic valve by a compressed-air generator device 96 of a known type, controlled by an electronic controller 20, which will be described hereinafter.

In operation, it is preferable that the central sleeve 93 is normally under pressure, thus preventing the tube from moving, and isolating the chamber from the outside environment; when necessary, the tube can be allowed to slide by releasing the pressure.

The flexible tube 12 outside the chamber is guided by a first idle wheel 15, positioned vertically above the washing head 10, which deviates the tube towards another idle wheel 16, which is positioned laterally relative to said first idle wheel and which, in addition to turning idly about its own axis, can also translate horizontally, being mounted on a controlled horizontal electric axis or guide 17. The latter is provided with an inner rail 18 in which the pin of the wheel 16 can slide.

The outer terminal of the flexible tube 12 has a fixed connection 19 through which the washing/rinsing solution is injected under pressure into the tube and then sprayed by the head 10. The fixed connection 19 may, for example, be secured to the container 22, which will be described hereinafter, if present, or in another known manner.

Figure 2:
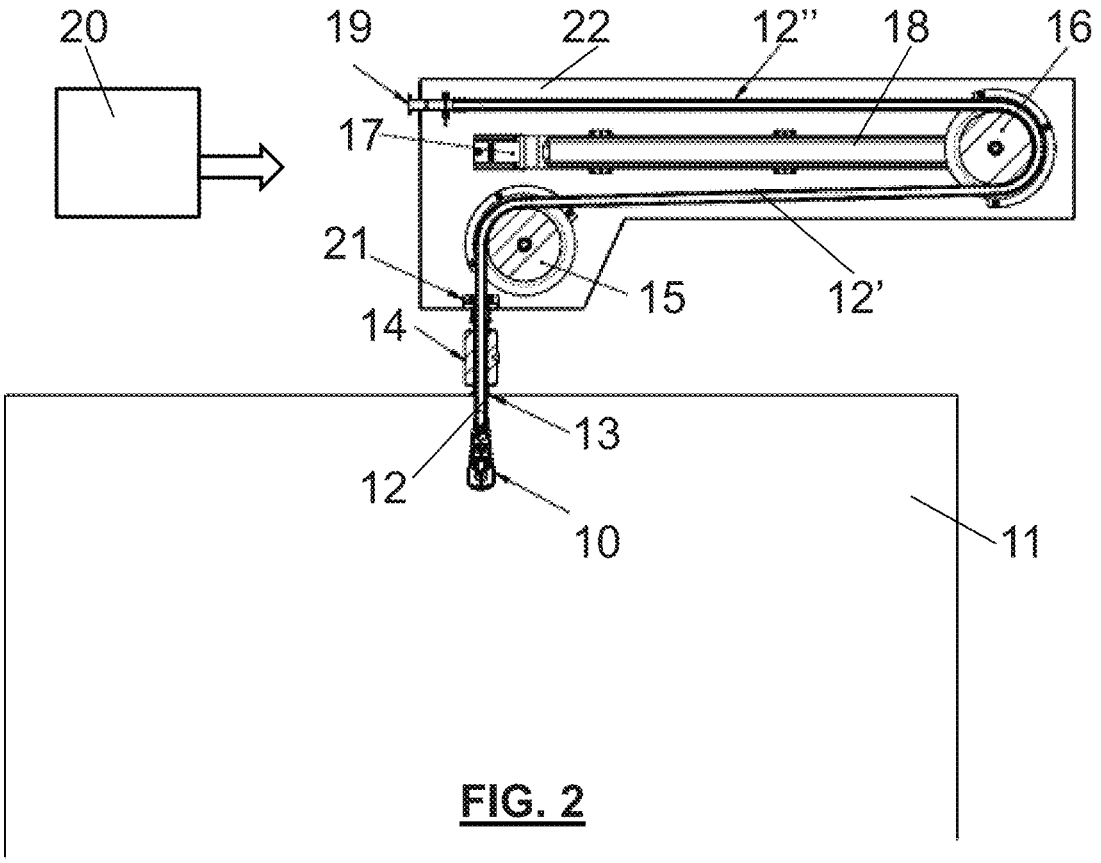
FIGS. 2, 3 and 4 show an exemplifying embodiment of the system for moving a washing head according to the invention, with the washing head in raised, intermediate and lowered positions, respectively, in the washing apparatus.
Figure 6:
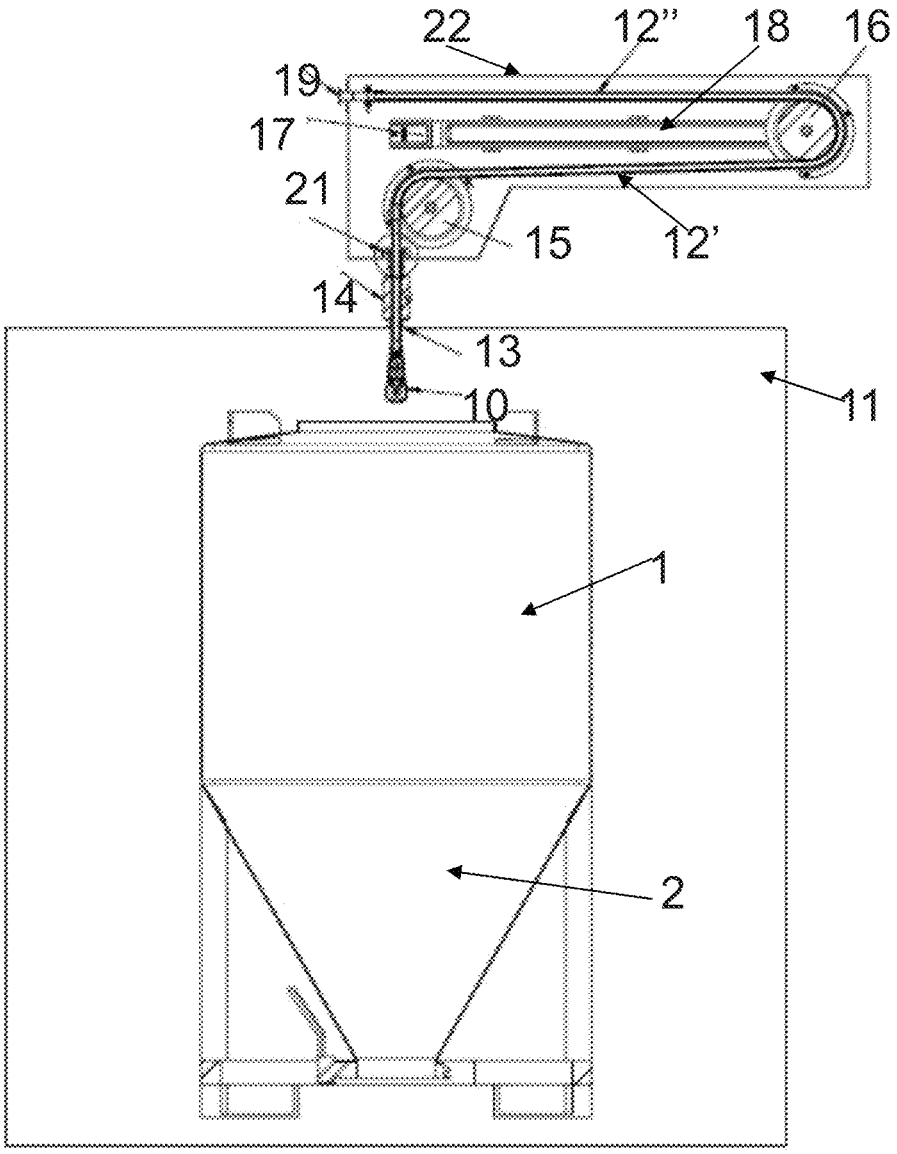
FIGS. 6 and 7 show a bin inserted in the washing apparatus, with the washing head in the raised position, outside and over the bin, and inside the bin, respectively.

In the position shown in FIG. 2, the head 10 remains high in the chamber 11, thus making it possible to place a bin to be washed into the chamber without any interference with the head (see, for example, FIG. 6).

In this condition, the sleeve valve 14 is closed, i.e. the sleeve presses against the outer surface of the tube 12 so as to keep the chamber isolated from the outside environment.

Figure 7:
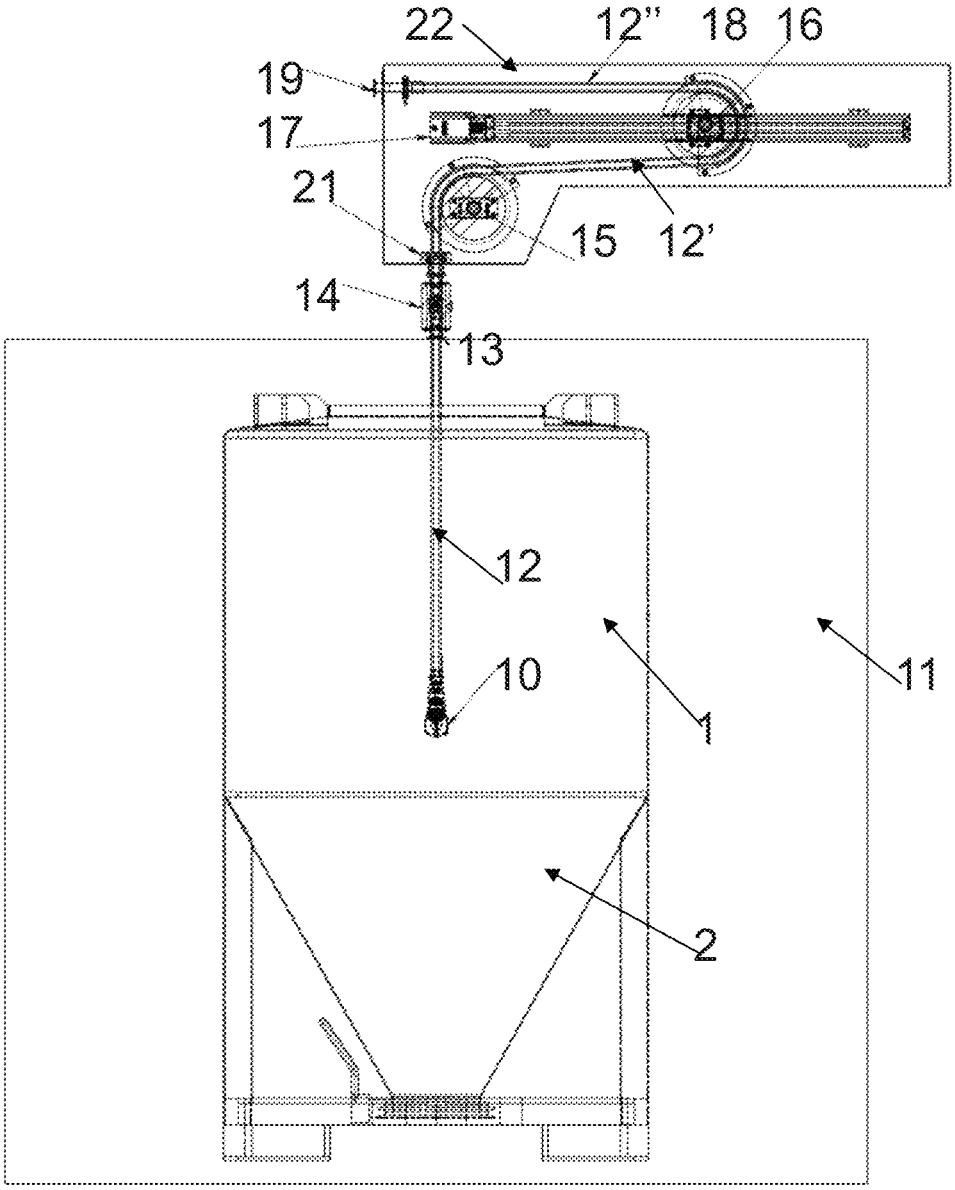

After the bin has been placed into the chamber and the automatic washing cycle has been started, the head 10 can be lowered inside the bin at the washing height(s) set in the recipe as follows (see, for example, FIG. 7): a blowing system 21 is activated which, by means of sterile compressed air, forms an air ring that keeps the technical/outside environment separate from the interior of the chamber. An air blade is thus created at a higher pressure than the surrounding environment, forming an air barrier.

Figure 10:
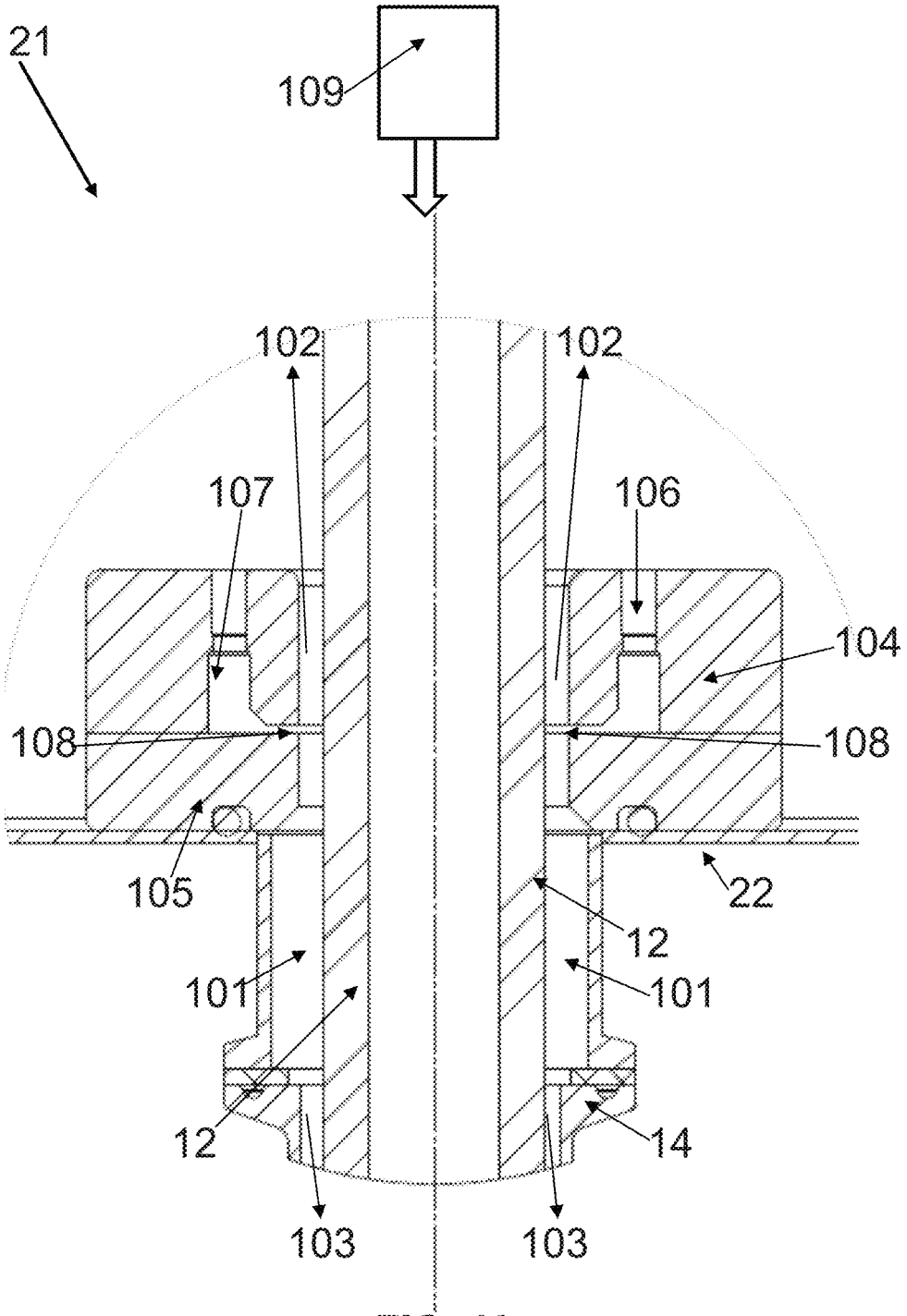
FIG. 10 shows a magnified sectional view of the blowing system included in the moving system.

One example of embodiment of the blowing system 21 is shown in a sectional view in FIG. 10. It comprises:

an empty central chamber 101 around the flexible tube 12, adapted to let the air blade flow and exit through the top 102 and bottom 103 edges;

a central stainless-steel collar around the empty chamber, comprising an upper part 104 and a lower part 105 connected to the central part;

wherein within the interspace between the two parts 104, 105 there is a radial slit 108 that connects the empty central chamber to the holes 106, 107 for taking in compressed air from the outside.

Compressed air is supplied through a pneumatic valve by a known compressed-air generator device 109 controlled by an electronic controller 20, which will be described hereinafter. The generator 109 may be the same generator 96 as previously described.

The blowing system 21 is connected to the container 22. The bottom edge is connected to the sleeve valve 14. When the sleeve valve 14 is open, a gap is de facto formed around the flexible tube 12, so that the compressed air will also flow though the sleeve valve 14 towards the inside of the chamber 11. Therefore, the blowing system is activated when the flexible tube 12 is sliding.

When the sleeve valve 14 is opened, that part of the flexible tube 12 to which the head 10 is connected can move in the vertical direction.

The electric axis 17 is then activated with controlled speed and displacement, thereby causing the wheel 16 mounted thereon to translate.

The electric axis with an internal rail may be of a known type, e.g. ball recirculation, rack, belt.

Because of the weight force generated by the washing head 10 and the sliding friction between the flexible tube 12 and the wheels 15, 16, the head will translate downwards and the wheels will accompany the movement by turning about their own axis.

A horizontal movement X of the wheel 16 on the electric axis 17 will thus produce a vertical movement Z=2X of the washing head 10. When the washing head 10 has arrived at the desired position, the sleeve valve 14 is closed again and the blowing system is deactivated.

The process can be activated and repeated for different washing positions, and everything will always be monitored by controlling the electric axis 17. Control is provided by an electronic controller 20 of a per se known type, which controls all the operations of the apparatus. In particular, the electronic controller 20 controls the opening and closing of a given number of pneumatic valves adapted to control the pressurized air flows, generated by the above-described compressed-air generators, and the intake of washing/rinsing liquid in the flexible tube.

Figure 3:
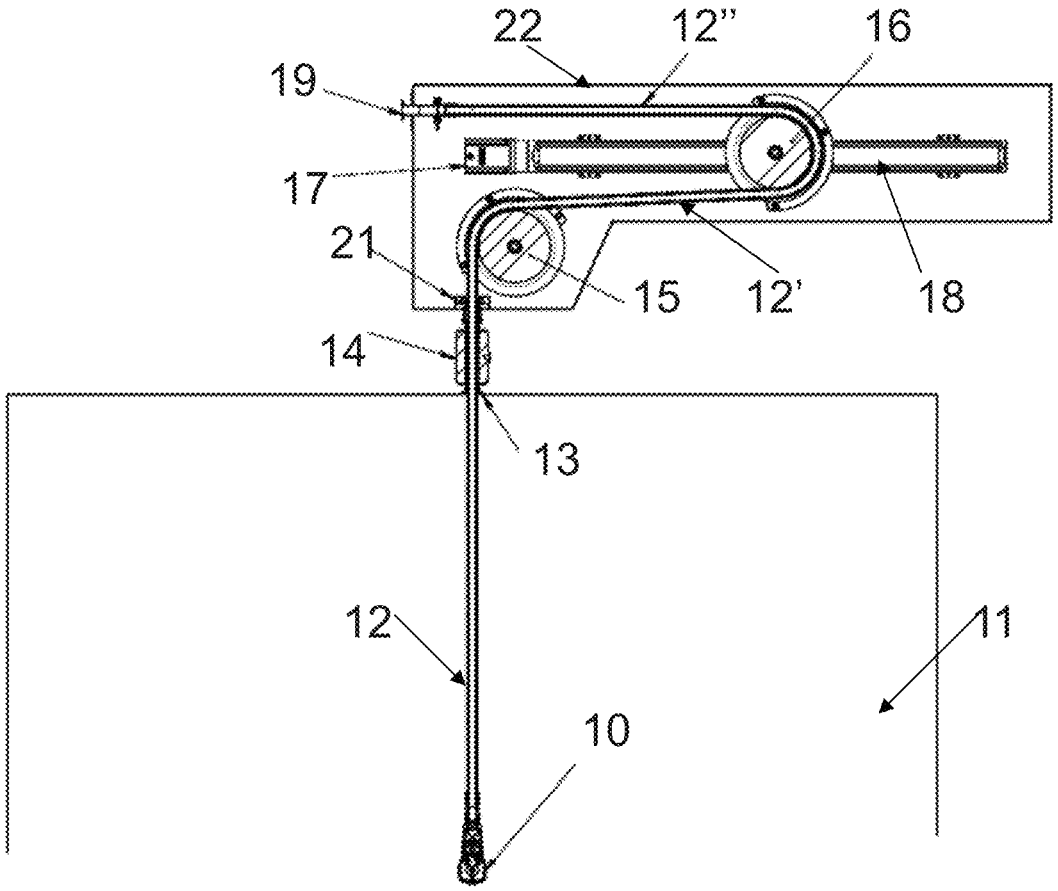
Figure 4:
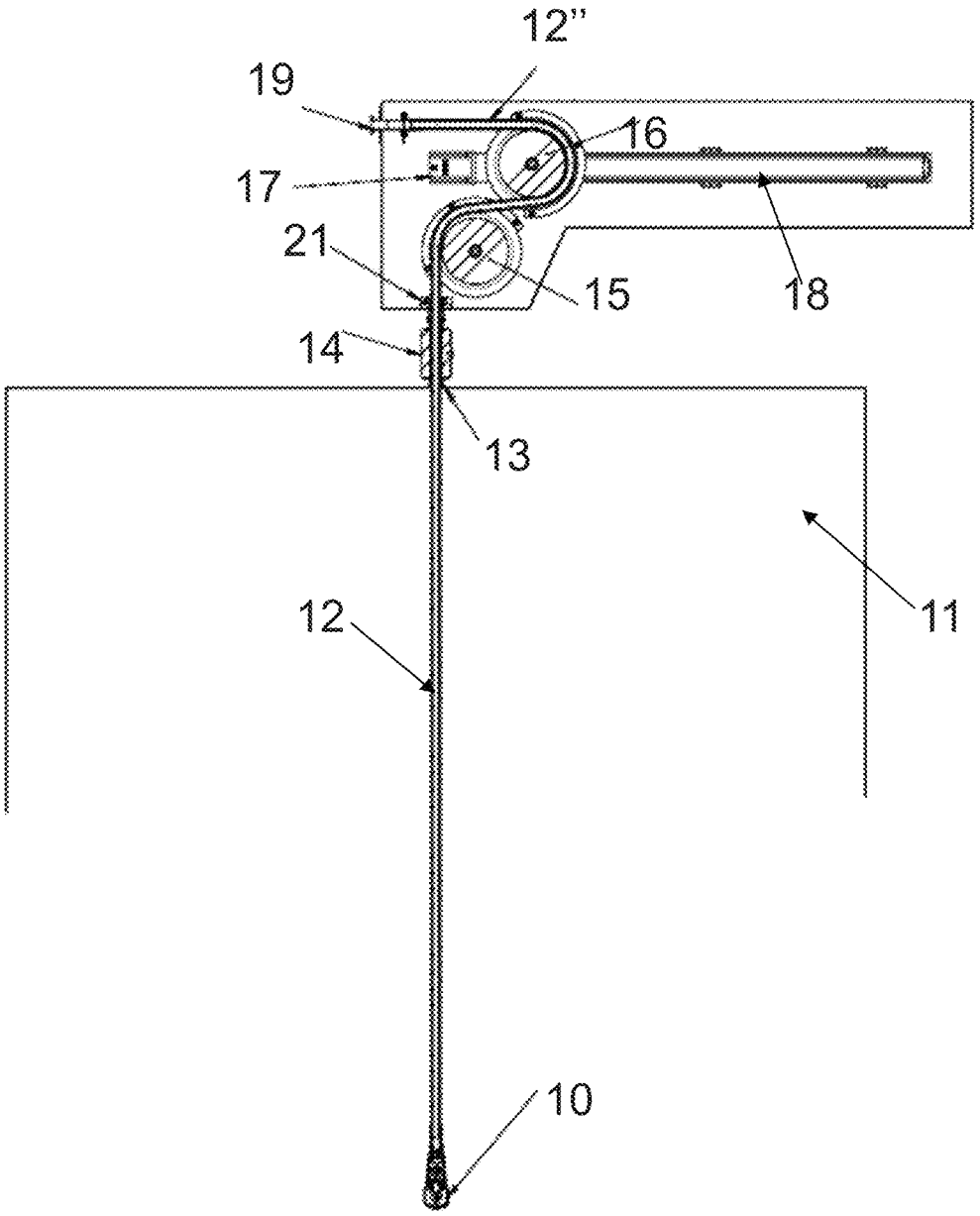
Figure 5:
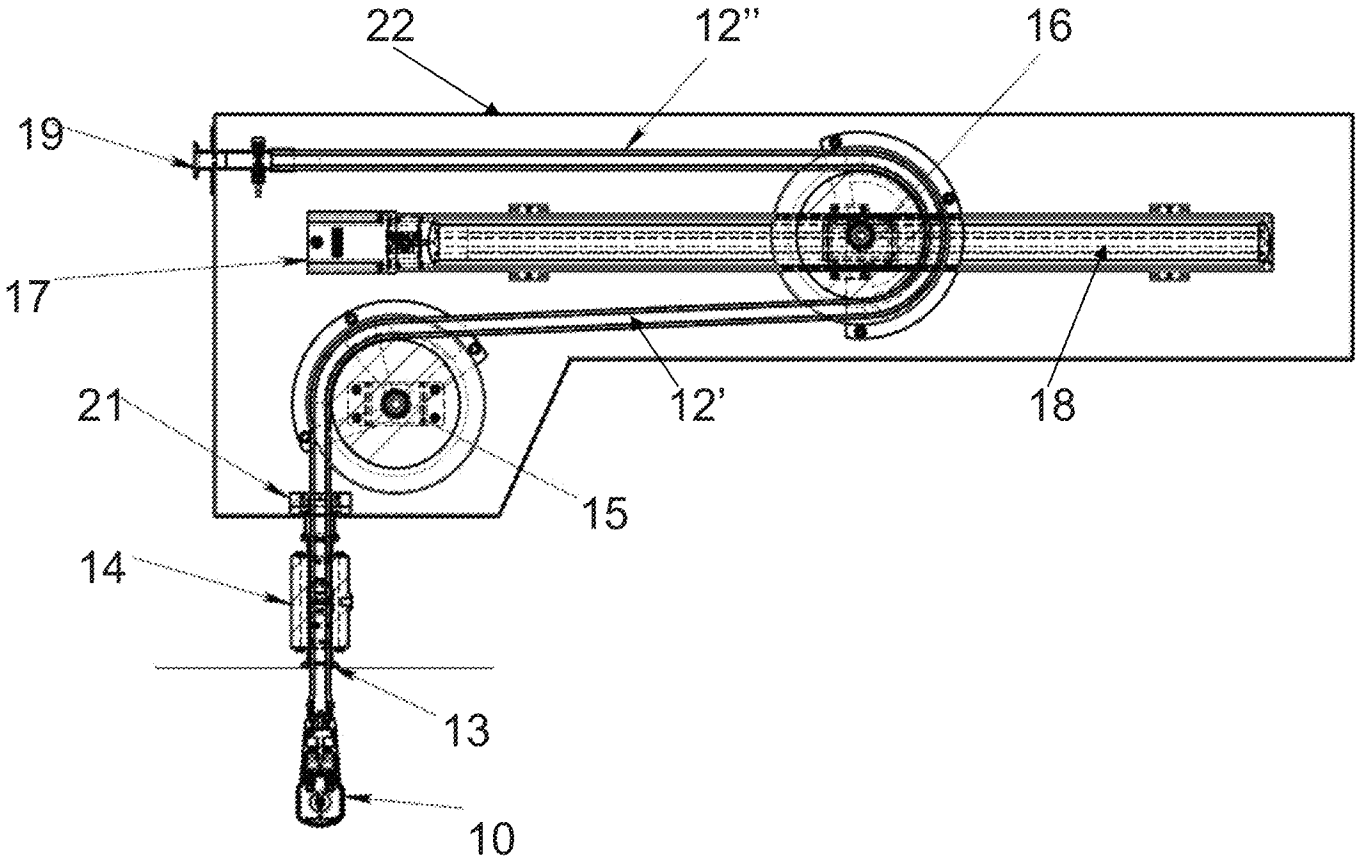
FIG. 5 shows some magnified details of the moving system.

In FIGS. 3 and 4 two possible positions of the washing head 10 inside the chamber 11 are shown, i.e. an intermediate and a lower position, respectively, corresponding to different relative positions of the wheel 16 in the electric axis 17.

The downward vertical travel of the head 10 is defined by the end of stroke of the electric axis 17, which is appropriately selected to coincide with the mechanical travel limit of the system, defined by the minimum allowable distance without interference between the two wheels 15, 16 (FIG. 4).

Once the washing/rinsing phases have been completed, the washing head can be drawn back into the high position by the electronic controller 20 by moving the wheel 16 away from the wheel 15, so that the bin can be removed.

In this case, the blowing system 21, which is activated while the washing head is moving, also performs a drying function on the flexible tube, if the drying cycle has not been activated in the recipe. This means that, should any water or detergent residues be present on the flexible tube 12 after the cycle just finished, such residues will be removed from the tube by the mechanical action exerted by the compressed air.

The flexible tube is mounted in a manner such as to be always draining towards the washing head. The two branches of the flexible tube 12' and 12" upstream and downstream of the wheel 16 are slightly inclined relative to the horizontal towards the head position, so that they can drain any residual liquid towards the head, which is provided with drain holes. Therefore, the flexible tube essentially comprises three branches, i.e. one which is essentially vertical, to which the washing head is connected, and two (12', 12") which are essentially horizontal and slightly inclined from the connection 19 towards the washing head 10. The three branches can rotate on the wheels 15 and 16.

Preferably, the head moving system is enclosed in a container 22, e.g. made of sheet-steel, adapted to keep the components of the moving system safe and clean.

It is apparent that such a system can considerably reduce the installation dimensions.

The minimum limit (in height) is given by the dimensions of the wheels, which must be compatible with the radius of curvature of the tube.

Furthermore, it is possible to determine the maximum stroke of the electric axis as a function of the desired maximum vertical travel of the head.

The above-described example of embodiment may be subject to variations without departing from the protection scope of the present invention, including all equivalent designs known to a man skilled in the art.

The elements and features shown in the various preferred embodiments may be combined together without however departing from the protection scope of the present invention.

From the above description, those skilled in the art will be able to produce the object of the invention without introducing any further construction details.

The invention claimed is:

1. A system for moving a washing/rinsing head in a bin washing/rinsing apparatus for the pharmaceutical industry, said apparatus being equipped with a washing/rinsing chamber adapted to house a bin and said washing/rinsing head, said bin being provided with an opening adapted to allow said head to be introduced therein, the system being positioned over said washing/rinsing chamber and comprising:

a flexible tube, to one end of which said washing/rinsing head is connected, said flexible tube being adapted to carry washing/rinsing liquid, fed through a fixed second end of the tube, towards said washing/rinsing head;

a first idle wheel, positioned vertically above said washing/rinsing head, and adapted to cause a first deviation of said flexible tube towards a second idle wheel;

said second idle wheel, positioned laterally relative to said first idle wheel, adapted to cause a second deviation of said flexible tube in a direction substantially opposite to said first deviation;

a horizontal electric guide adapted to slidably house a pin of said second idle wheel;

said first and second idle wheels being adapted to deviate said flexible tube so that it runs along essentially horizontal sections towards said fixed second end;

an electronic controller adapted to cause said pin of said second idle wheel to slide within said horizontal electric guide, so as to control a vertical position of said washing/rinsing head in the washing/rinsing chamber through the sliding of said flexible tube on said first and second idle wheels.

2. The system for moving a washing/rinsing head according to claim 1, comprising a sleeve valve positioned over said washing/rinsing chamber, controlled by said electronic controller, adapted to stop or release said flexible tube.

3. The system for moving a washing/rinsing head according to claim 1, wherein said horizontal electric guide comprises an inner rail, in which said pin of the second idle wheel slides.

4. The system for moving a washing/rinsing head according to claim 1, comprising a container that encloses it.

5. The system for moving a washing/rinsing head according to claim 1, wherein said washing/rinsing head is adapted to slide vertically into said bin through said opening.

6. The system for moving a washing/rinsing head according to claim 1, wherein said flexible tube comprises:

an inner layer made of translucent silicone;

an outer layer made of heat-resistant smooth silicone;

an intermediate layer comprising reinforcement layers made of temperature-resistant and pressure-resistant textile with a stainless-steel spiral in between.

7. The system for moving a washing/rinsing head according to claim 2, wherein said sleeve valve comprises:

a central cavity adapted to house said flexible tube;

a body made of stainless steel;

a central sleeve made of EPDM rubber, adapted to act as a vice for compressing or releasing said flexible tube;

two flange-shaped terminal parts;

a central inflation chamber, positioned between said body and said central sleeve;

an inlet for compressed air to be used for compressing or releasing said central sleeve.

8. The system for moving a washing/rinsing head according to claim 1, comprising a blowing system, controlled by said electronic controller, adapted to blow compressed air and form an air ring around said flexible tube, said blowing system comprising:

an empty central chamber around the flexible tube, comprising top and bottom edges, said empty central chamber being adapted to let said compressed air flow and exit through said top and bottom edges;

a central collar around the empty chamber, comprising an upper part and a lower part connected to each other;

wherein within the interspace between said upper part and said lower part there are radial holes adapted to connect said empty central chamber to holes for taking in said compressed air from the outside.

9. A method of using the system for moving a washing/rinsing head according to claim 1, comprising controlling said electronic controller in such a way as to cause said pin of the second idle wheel to slide within said horizontal electric guide, the flexible tube to slide around said first and second idle wheels, and said washing/rinsing head to be vertically positioned in said washing/rinsing chamber.

10. The method of using the system for moving a washing/rinsing head according to claim 9, comprising an initial step of positioning said bin in said washing/rinsing chamber so as to allow for said vertical positioning of said washing/rinsing head into said bin through said opening.

* * * * *